US006722500B2

(12) United States Patent
Deiger

(10) Patent No.: US 6,722,500 B2
(45) Date of Patent: Apr. 20, 2004

(54) ENVELOPE PACKAGE FOR GLASS ARTICLES

(76) Inventor: Anthony Deiger, 60 Linden La., Perrysburg, OH (US) 43551

( * ) Notice: Subject to any disclaimer, the term of this patent is extended or adjusted under 35 U.S.C. 154(b) by 57 days.

(21) Appl. No.: 09/910,472

(22) Filed: Jul. 20, 2001

(65) Prior Publication Data

US 2002/0036151 A1 Mar. 28, 2002

Related U.S. Application Data

(60) Provisional application No. 60/219,742, filed on Jul. 20, 2000.

(51) Int. Cl.[7] ..... B65D 85/48

(52) U.S. Cl. ..... 206/454; 206/449

(58) Field of Search ..... 206/448, 454, 206/521, 523, 455, 449, 312, 313, 813; 229/68.1, 77, 87.01, 87.18, 103.2, 108

(56) References Cited

U.S. PATENT DOCUMENTS

| | | | | |
|---|---|---|---|---|
| 2,740,518 A | | 4/1956 | Kincaid | |
| 2,917,166 A | | 12/1959 | Lidgard | |
| 3,028,001 A | | 4/1962 | Gleim | |
| 3,166,188 A | | 1/1965 | Koester | |
| 3,860,116 A | | 1/1975 | Castine, Jr. | |
| 3,938,660 A | | 2/1976 | Moehring | |
| 3,944,131 A | * | 3/1976 | Weiss | 206/454 |
| 4,287,990 A | | 9/1981 | Kurick | |
| 4,711,347 A | * | 12/1987 | Drexler et al. | 206/449 |
| 4,802,618 A | * | 2/1989 | Seto et al. | 206/454 |
| 5,429,858 A | | 7/1995 | Gold | |

* cited by examiner

*Primary Examiner*—Luan K. Bui
(74) *Attorney, Agent, or Firm*—John C. Purdue; David C. Purdue

(57) ABSTRACT

A glass sheet, and a shipping case for the sheet are disclosed. The shipping case comprises two paperboard sheets with central portions which are substantially coextensive with and on opposite sides of the major surfaces of the sheet, and pairs of opposed, substantially coextensive flaps which surround the central portions. An adhesive prevents movement of the opposed flaps relative to one another and of the sheet within the case. In a preferred embodiment the flaps of one of the pairs are integral with one another and are disposed on opposite sides of a fold line. In another preferred embodiment, the shipping case additionally includes at least one flap which is structurally integral with one of the paperboard sheets along an edge thereof, and is folded around a peripheral edge of the article and adhered to the exterior surface of the central portion of the other sheet.

7 Claims, 8 Drawing Sheets

FIG. 2
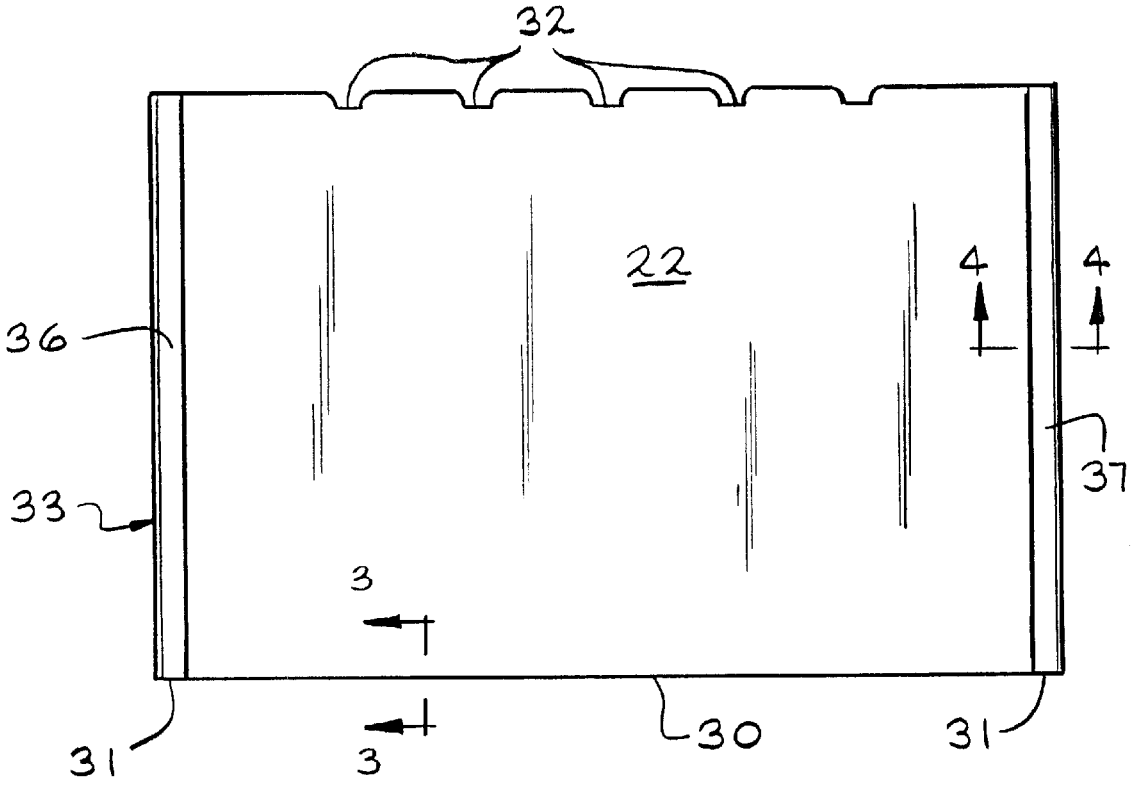
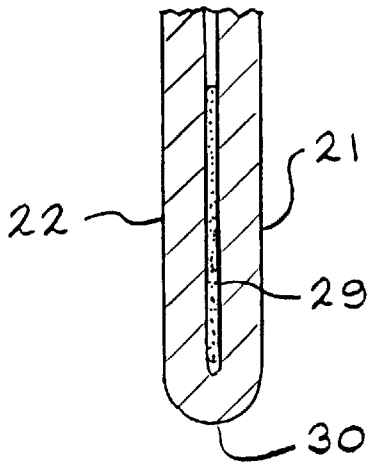
FIG. 3
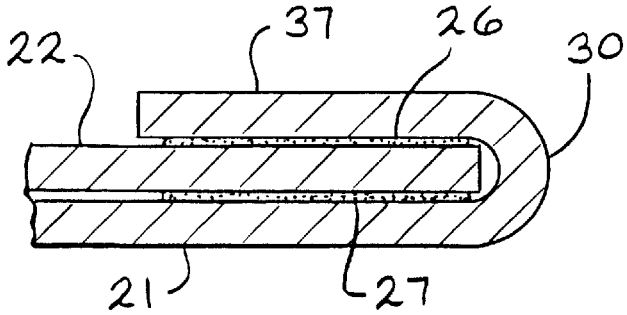
FIG. 4

FIG. 6
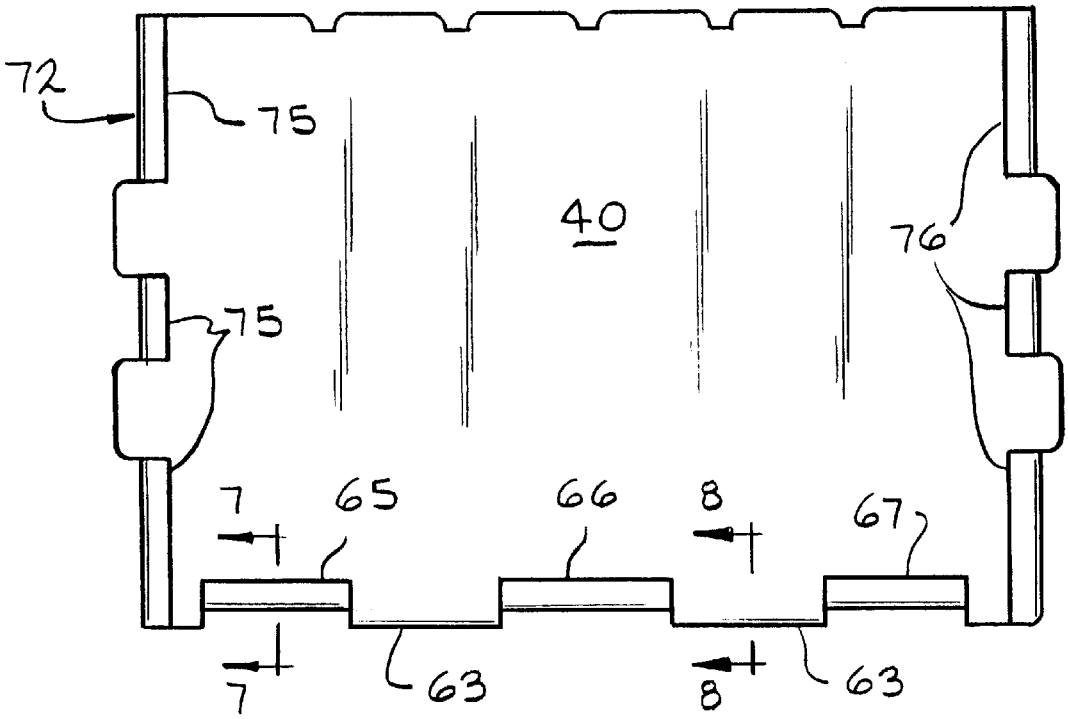
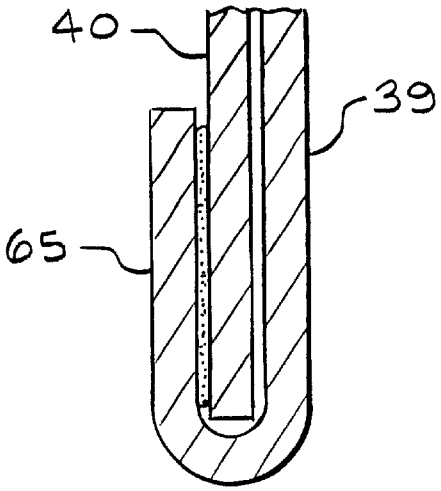
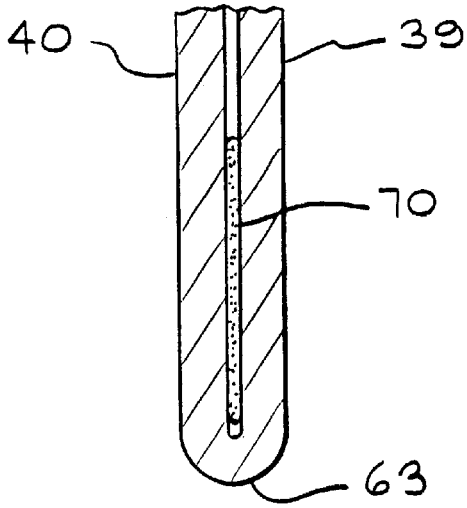
FIG. 7
FIG. 8

ENVELOPE PACKAGE FOR GLASS ARTICLES

REFERENCE TO RELATED APPLICATION

The benefit of the filing date of provisional application No. 60/219,742 filed Jul. 20, 2000 is claimed.

BACKGROUND OF THE INVENTION

1. Field of the Invention

This invention is an envelope package for protecting fragile sheets, especially glass sheets, in transit and in storage.

2. Description of the Prior Art

Glass sheets, especially curved automotive glass sheets, are presently shipped and stored in sleeves made of two corrugated sheets which are sewn together along two or three sides. U.S. Pat. No. 3,860,116 discloses a packaging device for glass articles. The package comprises front and rear panels which are sewn together adjacent to a bottom edge and two side edges to define an envelope structure. Surprisingly, much the same package is used today for curvilinear automotive glass sheets.

There are some practical problems with the sewn envelope package. The sewing of corrugated board and the like is a very slow process which is rather inefficient. The process becomes even more inefficient when needles break and the process is stopped for the replacement of needles. A sewn envelope structure has performance problems as well. When a needle perforates the front and back panels, it effectively scores those panels and weakens them, predisposing the envelope structure to failure at the perforations. As automotive glass has become more curved, the strain the glass imposes on the panels where they are sewn together has increased, thereby increasing the frequency of this type of failure. Such a failure exposes the most vulnerable part of a glass panel, which is an edge.

U.S. Pat. No. 2,917,166 discloses a package especially adapted for automotive windshields. This package is essentially constructed around a glass panel and has front and rear panels which are held together by staples and tape or metal straps. Accordingly, the package requires a great deal of labor to secure it to and around a glass panel.

U.S. Pat. No. 3,028,001 discloses a packaging device especially suited for curved glass panels such as windshields. The package comprises front and rear panels and tabs adjacent upper and lower edges of the front panel. There are slots above the tabs adjacent the upper edge and below the lower edge of the of the front panel. A glass panel is positioned on the front panel; the tabs are folded over the edges of the glass panel; and the rear panel is brought into contact with the glass panel; slots in the rear panel are then aligned with the slots above and below the tabs of the front panel. Next, tape is wrapped around the front and rear panels, passing through the aligned slots therein. The tape secures the tabs in their folded positions where they engage the glass panel. This package is also literally constructed around a glass panel.

U.S. Pat. No. 3,166,188 discloses a packaging device for automotive glass. The package comprises a cover panel and a supporting panel. Upper and lower flaps formed in the cover panel are folded to engage a sheet of glass and then banding straps or strips of tape are passed around the package to secure the flaps in position where they engage and retain the glass sheet in place. The ends of the package are folded inwardly to engage the side edges of the glass sheet and the entire package is stapled to secure the end portions adjacent to the side edges and to secure the cover panel to the supporting panel. Again, this package is literally constructed around a glass sheet.

U.S. Pat. No. 2,740,518 discloses an envelope within a box concept for packaging glass sheets, especially curved automotive glass. The sheet is received in an envelope comprised of a bottom protective liner and a top protective liner. The bottom liner has foldable flaps on four edges which are bent inwardly, preliminarily, to engage the edges of a glass sheet.

SUMMARY OF THE INVENTION

The present invention, in one embodiment, is an article of sheet form and a shipping case for the article. The shipping case comprises a paperboard sheet which is folded upon itself along a fold line, and is so shaped that, in its folded condition, it has first and second polygonyl sheet members with opposed major surfaces and n edges. The central portions are substantially coextensive with the major surfaces of the article, while the n edges surround the central portions of the major surfaces. One of the edges is common to the first and second sheet members along the fold line. There are at least three pairs of opposed, substantially coextensive flaps, one of which extends outwardly beyond the central portions of the members to the fold line and each of the others of which extends outwardly beyond the central portions of the members to another edge. Each of the flaps is integral with the central portion of one of the members, which are positioned so that one is on each side of the article and the article is sandwiched between the central portions of the members. There is a body of an adhesive disposed between facing surfaces of the flaps of each of the pairs. Each of the bodies of adhesive is operable to prevent movement relative to one another of the flaps between whose facing surfaces it is disposed, and to prevent the article from sliding between the facing surfaces of the flaps between whose facing surfaces it is disposed.

In a preferred embodiment, the shipping case according to the invention additionally includes at least one flap which is structurally integral with one of the members along an edge thereof, and is folded around a peripheral edge of the article and adhered by a body of adhesive to the exterior surface of the central portion of the second of said members.

OBJECTS OF THE INVENTION

It is, therefore, an object of the invention to provide an article of sheet form and a shipping case for the article.

Other objects and advantages will be apparent from the disclosure herein of preferred embodiments, reference being made to the attached drawings.

BRIEF DESCRIPTION OF THE DRAWINGS

FIG. 2 is a plan view of the shipping case produced by folding the lower portion of the sheet of FIG. 1 over the upper portion thereof, and hardening the glue.

FIG. 3 is sectional view taken along the line 3—3 of FIG. 2, and showing the structure of the portion of the shipping case of FIG. 2 which is adjacent a fold line along which the upper and lower portions of the sheet are connected.

FIG. 4 is a view in section taken along the line 4—4 of FIG. 2, and showing the structure of the portion of the shipping case of FIG. 2 which is adjacent a side edge thereof.

FIG. 6 is a plan view of the shipping case produced by folding the lower portion of the sheet of FIG. 5 over the upper portion thereof, and hardening the glue.

FIG. 7 is a sectional view taken along the line 7—7 of FIG. 6, and showing the structure of one portion of the shipping case of FIG. 6 which is adjacent a fold line along which the upper and lower portions of the sheet are connected.

FIG. 8 is a view in section taken along the line 8—8 of FIG. 6, and showing the structure of another part of the portion of the shipping case of FIG. 6 which is adjacent the fold line along which the upper and lower portions of the sheet are connected

DETAILED DESCRIPTION OF THE PREFERRED EMBODIMENTS

Figure 1:
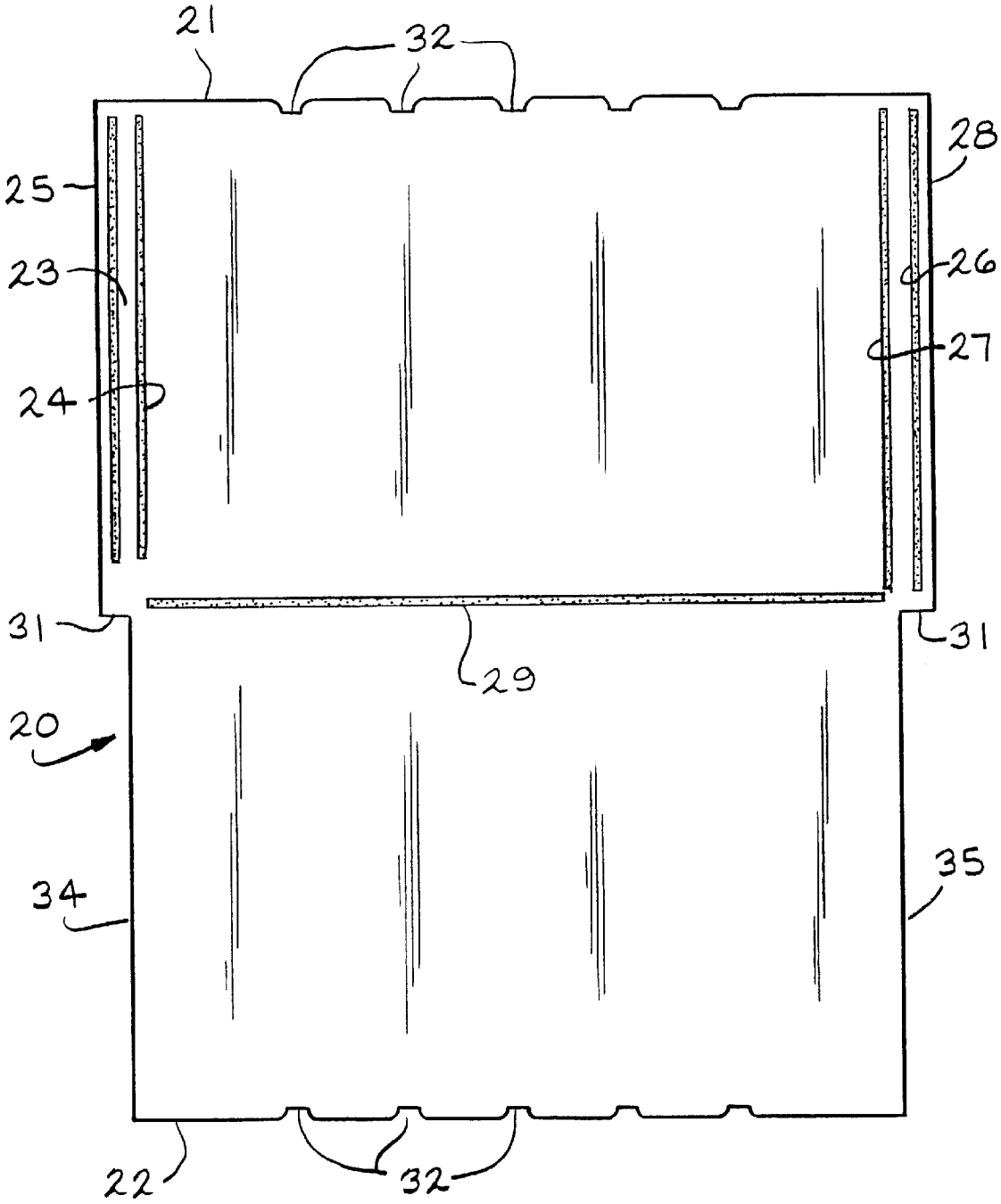
FIG. 1 is a plan view of a paperboard sheet which has a suitable shape, and to which glue has been applied, so that a lower portion of the sheet can be folded over the upper portion thereof and the glue can be hardened to produce a shipping case into which an appropriately sized sheet of glass or other material can be inserted.

Referring now in more detail to the drawings, and, in particular, to FIG. 1, a paperboard sheet which has a suitable shape for use in producing a shipping case according to the invention is indicated generally at 20. The sheet 20 has an upper portion 21 and a lower portion 22. As indicated at 23 and 24, bodies of glue have been applied to the upper portion 21 of the sheet 20 adjacent a side edge 25; bodies 26 and 27 of glue have been applied to the upper portion 21 of the sheet 20 adjacent a side edge 28; and a body 29 of glue has been applied to the upper portion 21 of the sheet 20 adjacent a bottom which, ultimately, is a fold line 30 (FIGS. 2 and 4) extending generally between steps 31 on opposed sides of the sheet 20 between the upper portion 21 and the lower portion 22. There are indentations 32 in the top edge of the upper portion 21 and in the bottom edge of the lower portion 22.

A shipping case according to the invention is indicated generally at 33 in FIG. 2. The shipping case 33 is produced from the paperboard sheet 20 of FIG. 1 by folding the lower portion 22 thereof along a line between the steps 31 onto the upper portion 21 so that a part of the lower portion adjacent a side edge 34 is in contact with the mass 24 of glue and a part adjacent a side edge 35 is in contact with the mass 27 of glue, folding parts of the upper portion 21 of the sheet 20 adjacent the side edges 25 and 28 over the side edges 34 and 35 of the lower sheet portion 22, and hardening the bodies 23, 24, 26, 27 and 29 of glue, which can be any glue known or hereafter developed. The parts adjacent the side edges 25 and 28 of the of the upper portion 21 of the sheet 20 which are folded over the side edges 34 and 35 of the lower sheet portion 22 are designated 36 and 37, respectively, in FIG. 2.

Figure 5:
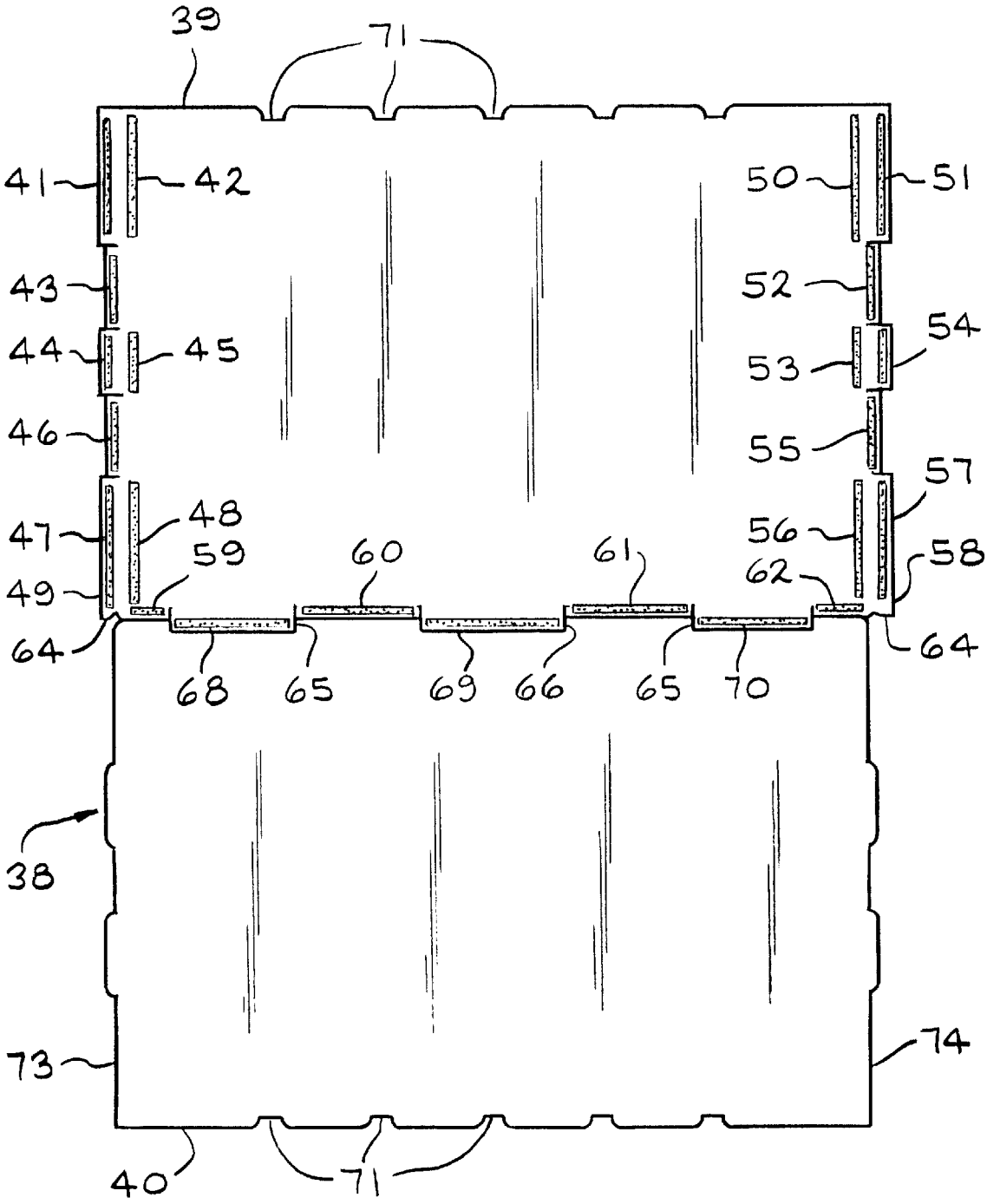
FIG. 5 is a plan view of another paperboard sheet which has a suitable shape, and to which glue has been applied, so that a lower portion of the sheet can be folded over the upper portion thereof and the glue can be hardened to produce a shipping case into which an appropriately sized sheet of glass or other material can be inserted.

Referring now to FIG. 5, a paperboard sheet which has a suitable shape for use in producing another embodiment of a shipping case according to the invention is indicated generally at 38. The sheet 38 has an upper portion 39 and a lower portion 40. As indicated at 41, 42, 43, 44, 45, 46, 47 and 48, bodies of glue have been applied to the upper portion 39 of the sheet 38 adjacent a side edge 49; bodies of glue 50, 51, 52, 53, 54, 55, 56 and 57 have been applied to the upper portion 39 of the sheet 38 adjacent a side edge 58, and bodies of glue 59, 60, 61 and 62 have been applied to the upper portion 39 of the sheet 38 adjacent a bottom thereof which, ultimately, is a fold line 63 (FIGS. 6 and 8) extending generally between steps 64 on opposed sides of the sheet 38 between the upper portion 39 and the lower portion 40. There are also three sided cut outs in the bottom of the upper portion 39 which extend downwardly into the lower portion 40, leaving rectangular tabs 65, 66, and 67 on the lower portions of which there are bodies 68, 69 and 70 of glue. There are indentations 71 in the top edge of the upper portion 39 and in the bottom edge of the lower portion 40.

Another shipping case according to the invention is indicated generally at 72 in FIG. 6. The shipping case 72 is produced from the paperboard sheet 38 of FIG. 5 by folding the lower portion 40 thereof along a line between the steps 64 onto the upper portion 39 so that a part of the lower portion adjacent a side edge 73 is in contact with the masses 42, 45 and 48 of glue and a part adjacent a side edge 74 is in contact with the masses 50, 53 and 56 of glue, folding parts of the upper portion 39 of the sheet 38 to which the masses 41, 44 and 47 of glue were applied over the side edge 73, folding parts of the upper portion 39 of the sheet 38 to which the masses 51, 54 and 57 of glue were applied over the side edge 74, folding the rectangular tabs 65, 66, and 67 over the lower portion 40 of the sheet 38, and hardening the several bodies of glue. The parts of the upper portion 39 which were folded over the edge 73 of the lower portion 40 of the sheet 38 are designated 75 in FIG. 6, while the parts of the upper portion 39 which were folded over the edge 74 are designated 76.

Figure 9:
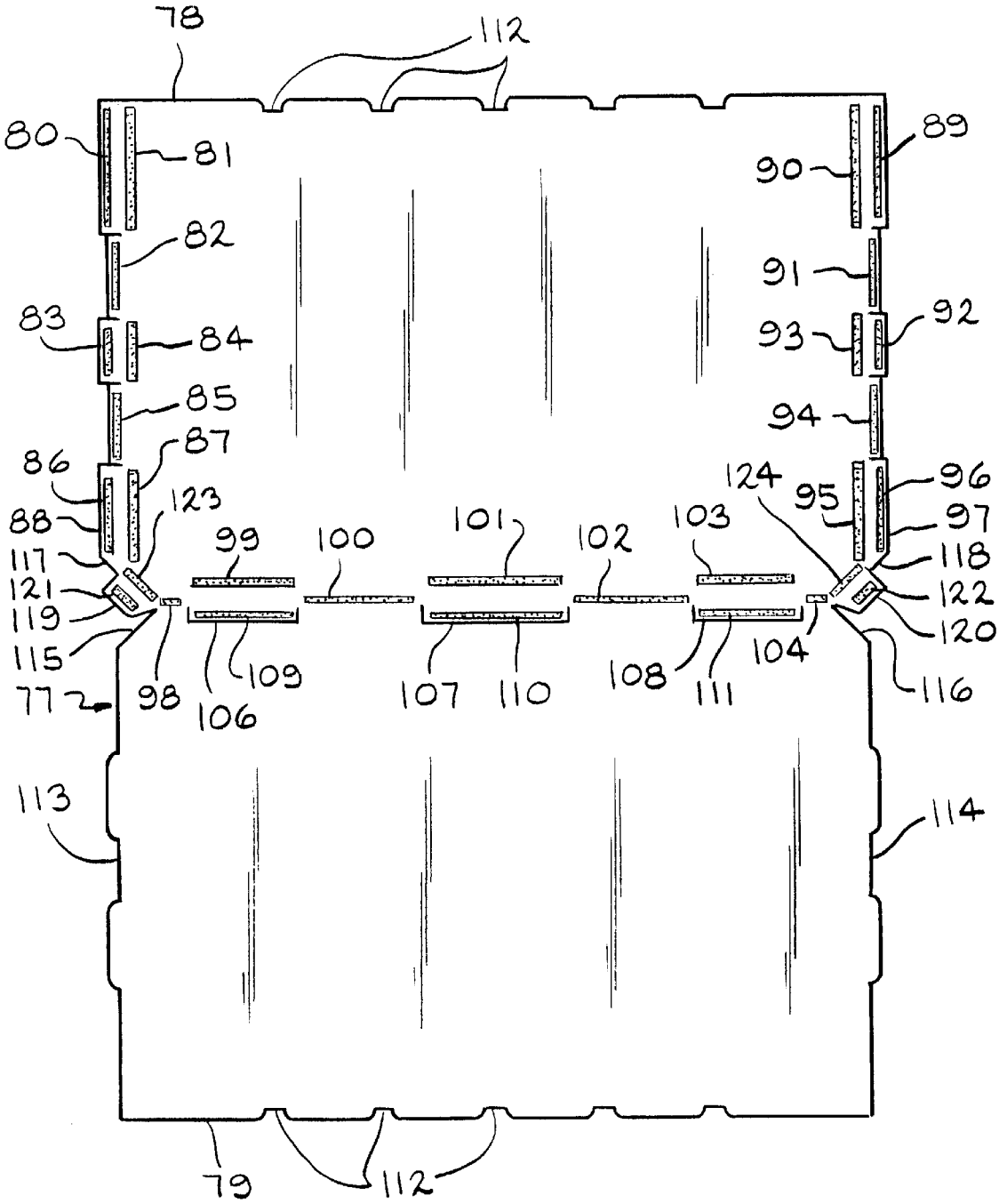
FIG. 9 is a plan view of still another paperboard sheet which has a suitable shape, and to which glue has been applied, so that a lower portion of the sheet can be folded over the upper portion thereof and the glue can be hardened to produce a shipping case into which an appropriately sized sheet of glass or other material can be inserted.
Figure 12:
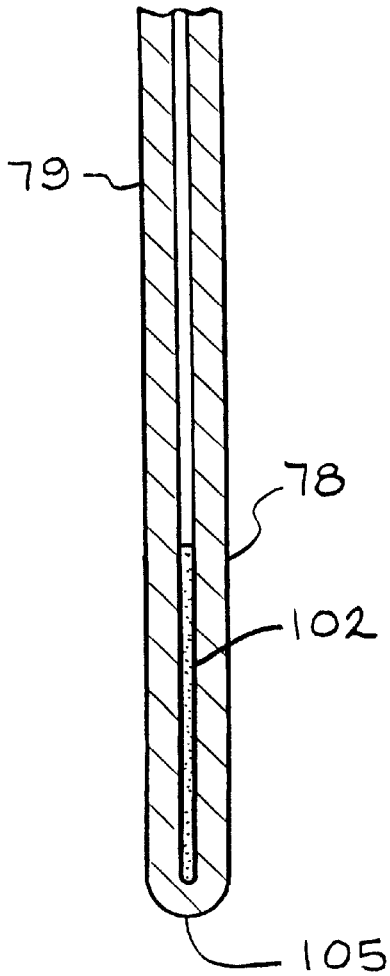
FIG. 12 is a view in section taken along the line 12—12 of FIG. 10, and showing the structure of another part of the portion of the shipping case of FIG. 10 which is adjacent the fold line along which the upper and lower portions of the sheet are connected.

Referring now to FIG. 9, a paperboard sheet which has a suitable shape for use in producing still another embodiment of a shipping case according to the invention is indicated generally at 77. The sheet 77 has an upper portion 78 and a lower portion 79. As indicated at 80, 81, 82, 83, 84, 85, 86 and 87 bodies of glue have been applied to the upper portion 78 of the sheet 77 adjacent a side edge 88; bodies 89, 90, 91, 92, 93, 94, 95 and 96 of glue have been applied to the upper portion 78 of the sheet 77 adjacent a side edge 97, and bodies 98, 99, 100, 101, 102, 103 and 104 have been applied to the upper portion 78 of the sheet 77 adjacent a bottom thereof which, ultimately, is a fold line 105 (FIG. 12) between the upper portion 78 (FIG. 9) and the lower portion 79. There are also three sided cut outs in the top of the lower portion 79 which leave rectangular tabs 106, 107 and 108 on the lower portions of which there are bodies 109, 110 and 111 of glue. There are indentations 112 in the top edge of the upper portion 78 and in the bottom edge of the lower portion 79.

The lower portion 79 of the paperboard sheet 77 has side edges 113 and 114, and re-entrant portions 115 and 116, while the upper portion 78 thereof has re-entrant portions 117 and 118 which extend inwardly from the side edges 88 and 97, respectively, toward the upper extremities of the re-entrant portions 115 and 116, and are so shaped that there are tabs 119 and 120 which are integral therewith. There are bodies 121 and 122 of glue on the tabs 119 and 120, and bodies of glue 123 and 124 spaced toward the center of the upper portion 78 of the paperboard sheet 77 from the bodies 121 and 122, respectively, of glue.

Figure 10:
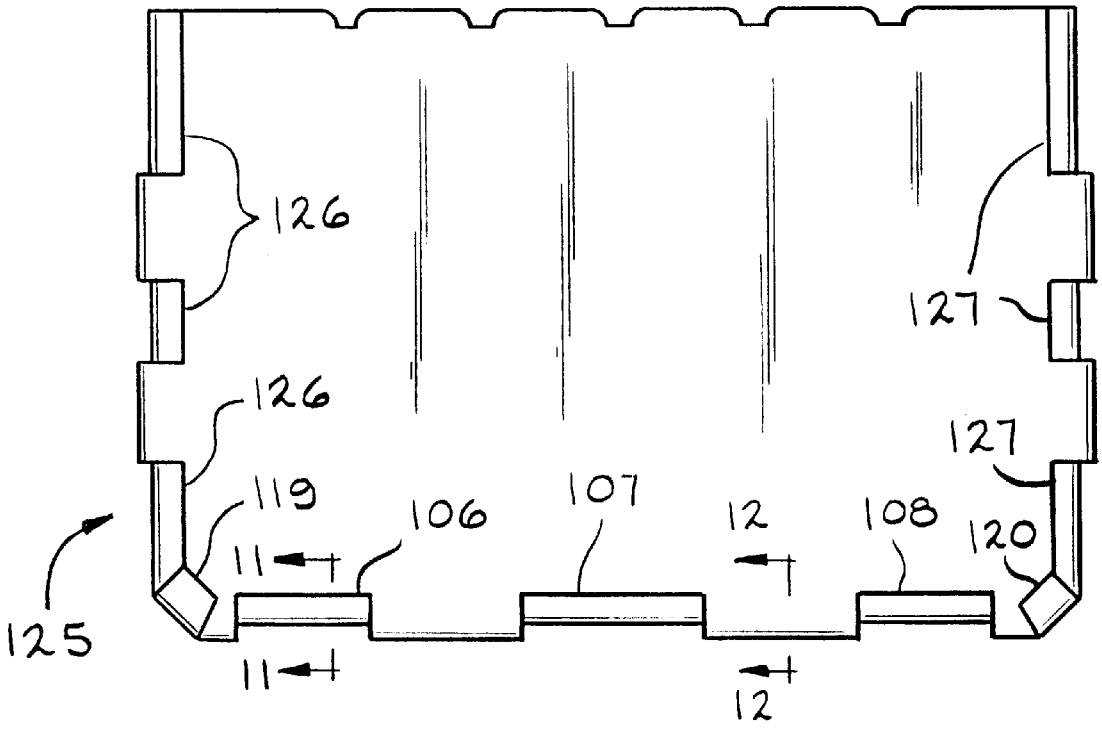
FIG. 10 is a plan view of the shipping case produced by folding the lower portion of the sheet of FIG. 9 over the upper portion thereof, and hardening the glue.
Figure 11:
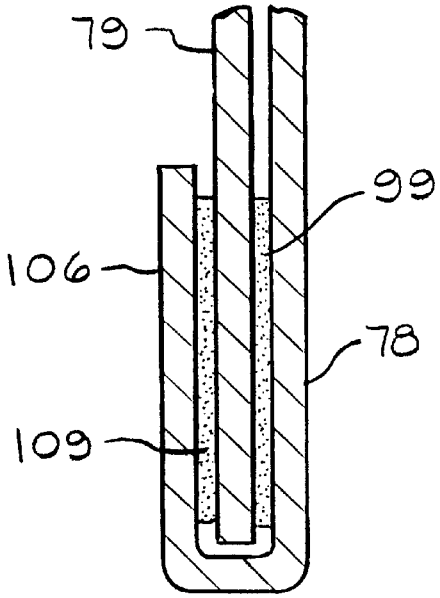
FIG. 11 is sectional view taken along the line 11—11 of FIG. 10, and showing the structure of one portion of the shipping case of FIG. 10 which is adjacent a fold line along which the upper and lower portions of the sheet are connected.

Still another shipping case according to the invention is indicated generally at 125 in FIG. 10. The shipping case 125 is produced from the paperboard sheet 77 of FIG. 9 by folding the lower portion 79 thereof along a line between the inner extremities of the re-entrant portions 115 and 116 so that a part of the lower portion adjacent the side edge 113 is in contact with the masses 81, 82, 84, 85 and 87 of glue and a part adjacent the side edge 114 is in contact with the masses 90, 91, 93, 94 and 95 of glue, while a part adjacent the top is in contact with masses 99, 100, 101, 102 and 103 of glue, folding parts of the upper portion 78 of the sheet 77 to which the masses 80, 83 and 86 of glue were applied over the side edge 113, folding parts of the upper portion 78 of the sheet 77 to which the masses 89, 92 and 96 of glue were applied over the side edge 114, folding the rectangular tabs 106, 107, and 108 over the lower portion 79 of the sheet 77, folding the tabs 119 and 120 over the re-entrant portions 115 and 116, and hardening the several bodies of glue. The parts of the upper portion 78 which were folded over the edge 113 of the lower portion 79 of the sheet 77 are designated 126 in FIG. 10, while the parts of the upper portion which were folded over the edge 114 are designated 127.

Figure 13:
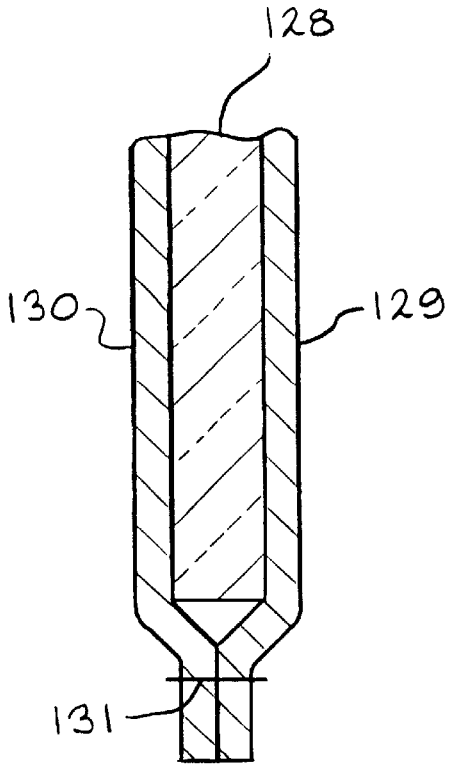
FIG. 13 PRIOR ART
FIG. 13 is a vertical sectional view similar to FIG. 12, but showing a portion of a shipping case that is disclosed in the prior art.
Figure 14:
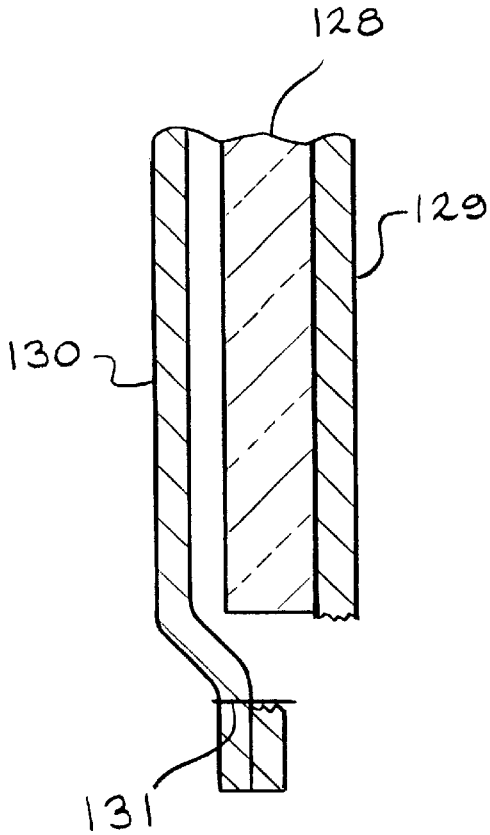
FIG. 14 PRIOR ART
FIG. 14 is a view in vertical section showing the prior art shipping case of FIG. 13 after a typical failure has occurred.

As has been indicated above, much the same sewn package that is shown in U.S. Pat. No. 3,860,116 is currently in use for curvilinear automotive glass sheets. A glass sheet indicated generally at 128 in such a sewn package is shown in FIG. 13. The package is composed of paperboard sheets 129 and 130 which are sewn together as indicated at 131 along two sides and a bottom, forming an envelope-like package having an opening along the top edge for receiving the glass article and urging the paperboard sheets toward each other (column 2, lines 19–25 of the patent). However, as noted above, when a needle perforates the front and back panels, it effectively scores and weakens those panels, predisposing them to failure along the perforations. When a break occurs, as shown in FIG. 14, the panels are no longer urged toward each other, and the edge of the glass sheet, which is the most vulnerable part, is exposed.

It will be appreciated that various changes and modifications are possible from the specific details of the invention shown in the attached drawings and described with reference thereto without departing from the spirit thereof as defined in the attached claims.

I claim:

1. In combination, an article of sheet form and a shipping case for the article, the shipping case comprising a paperboard sheet which is folded upon itself along a fold line, and is so shaped that, in its folded condition, it has first and second polygonyl sheet members with opposed major surfaces having central portions which are substantially coextensive with the major surfaces of the article, and at least 3 edges which surround the central portions of said major surfaces, one of said edges being common to the first and second sheet members along the fold line, at least three pairs of opposed, substantially coextensive flaps, a first one of which extends outwardly beyond the central portions of said sheet members to the fold line and second ones of which extend outwardly beyond the central portions of said sheet members to another edge, each of said flaps being integral with the central portion of one of said sheet members, said sheet members being positioned so that one is on each side of the article and the article is sandwiched between the central portions of said sheet members, and a body of an adhesive disposed between facing surfaces of the flaps of each of said pairs, each of said bodies of adhesive being operable to prevent movement relative to one another of the flaps between whose facing surfaces it is disposed, and each of said bodies of adhesive also being operable to prevent said article from sliding between the facing surfaces of the flaps between whose facing surfaces it is disposed.

2. An article and shipping case as claimed in claim 1 which has a total of five sides, first and second ones of which of which are generally parallel to one another and a third of which extends between said first and second sides, and substantially at a right angle thereto, the lengths of said first and second sides corresponding approximately with the width of said article, and the length of said third side corresponding approximately with the length of said article, and which additionally includes fourth and fifth sides, one of which extends between said third side and said first side and the other of which extends between said third side and said second side, said fourth and fifth sides having lengths which are not more than about 10 percent of the length of the third side, and intersecting said third side at an angle from about 40° to 50°.

3. An article and shipping case as claimed in claim 1 wherein a flap of one of said second pairs of flaps extends beyond the edge of the other flap of the pair, and is folded around that edge and adhered to the exterior surface of the other flap.

4. An article and shipping case as claimed in claim 1 wherein a flap of one of said second pairs of flaps is adjacent in the other flap of the pair, and extends beyond the edge of the other flap of the pair, and is folded around that edge and adhered to the exterior surface of the other flap adjacent the slot.

5. An article and shipping case as claimed in claim 2 wherein a flap of one of said second pairs of flaps extends beyond the edge of the other flap of the pair, and is folded around that edge and adhered to the exterior surface of the other flap.

6. An article and shipping case as claimed in claim 5 wherein a flap of each of the five second pairs of flaps extends beyond the edge of the other flap of the pair, and is folded around that edge and adhered to the exterior surface of the other flap.

7. In combination, an article of sheet form and a shipping case for the article, the shipping case comprising a pair of paperboard sheets with opposed major surfaces having central portions which are substantially coextensive with the major surfaces of the article, and at least 3 edges which surround the central portions of said major surfaces, at least three pairs of opposed, substantially coextensive flaps which extend outwardly beyond the central portions of said sheet members to an edge, each of said flaps being integral with the central portion of one of said sheet members, said sheet members being positioned so that one is on each side of the article and the article is sandwiched between the central portions of said sheet members, and a body of an adhesive disposed between facing surfaces of the flaps of each of said pairs, each of said bodies of adhesive being operable to prevent movement relative to one another of the flaps between whose facing surfaces it is disposed, and each of said bodies of adhesive also being operable to prevent said article from sliding between the facing surfaces of the flaps between whose facing surfaces it is disposed.

* * * * *